United States Patent [19]

Hilfiker

[11] 4,154,554

[45] May 15, 1979

[54] RETAINING WALL AND ANCHORING MEANS THEREFOR

[75] Inventor: William K. Hilfiker, Eureka, Calif.

[73] Assignee: Hilfiker Pipe Co., Eureka, Calif.

[21] Appl. No.: 893,707

[22] Filed: Apr. 5, 1976

Related U.S. Application Data

[63] Continuation-in-part of Ser. No. 839,443, Oct. 5, 1977, which is a continuation-in-part of Ser. No. 711,081, Aug. 3, 1976, Pat. No. 4,068,482.

[51] Int. Cl.[2] ..... E02D 5/74

[52] U.S. Cl. ..... 405/273; 52/166

[58] Field of Search ..... 61/39, 47, 35; 52/166, 52/564, 562, 426, 156; 405/273

[56] References Cited

U.S. PATENT DOCUMENTS

| | | | |
|---|---|---|---|
| 1,089,842 | 3/1914 | Johnson | 52/166 |
| 1,739,108 | 12/1929 | Weber | 61/47 |
| 2,149,957 | 3/1939 | Dawson | 61/47 |
| 3,316,721 | 5/1967 | Heilig | 61/39 |
| 3,861,106 | 1/1975 | Erhart | 52/166 |

*Primary Examiner*—Jacob Shapiro

*Attorney, Agent, or Firm*—Naylor, Neal & Uilkema

[57] ABSTRACT

A first embodiment employs precast cementitious stretchers provided with cast in place connectors for anchor rod ends. A second embodiment employs stretcher panels fabricated of resilient sheet material and secured together by straps which reinforce to panels and provide connectors for anchor rod ends. Both embodiments incorporate deadman anchors formed with slot-like openings through which end plates on the rods may pass and which serve to secure the plates against removal from anchors when the rods are secured to the connectors of the stretchers.

6 Claims, 7 Drawing Figures

RETAINING WALL AND ANCHORING MEANS THEREFOR

RELATED APPLICATIONS

This application is a continuation-in-part of my copending application, Ser. No. 839,443, filed Oct. 5, 1977 for "Anchoring Means for Retaining Walls", which application is a continuation-in-part of my application Ser. No. 711,081, filed Aug. 3, 1976 for "Retaining Wall Structure Using Precast Stretcher Sections", now U.S. Pat. No. 4,068,482.

BACKGROUND OF THE INVENTION

The present invention relates to retaining walls for earth formations, and, more particularly is directed to such walls of the type wherein a retaining wall comprised of an assembly of stretchers is anchored in place through means of deadman anchors which are secured to the wall by anchor rods and then held in place with back fill.

My prior U.S. Pat. No. 4,068,482 discloses a retaining wall of the type with which the present invention is concerned and is particularly significant to the first embodiment of the present invention in that, like that embodiment, it employs precast cementitious stretchers. The first embodiment of the present invention is an improvement over that of my patent 4,068,482 primarily in that it employs connectors for the deadman anchor rods which are embedded into the bodies of the stretchers, rather than disposed between the stretchers. It is also an improvement over the invention of the patent in that it employs an improved connector for connecting the anchor rod to the deadman, which connector facilitates ease of assembly of the retaining wall structure and assures that a secure connection of the anchor rod is provided to both the deadman anchors and the retaining wall stretchers.

The second embodiment of the present invention differs from the first embodiment very significantly insofar as the construction of the stretchers is concerned. In the second embodiment, the stretchers comprise panels fabricated of resilient sheet material, such as steel. These panels are secured together by straps which also provide the connectors for the anchor rods which extend to the deadman anchors. A patent very significant to the retaining wall of the second embodiment is U.S. Pat. No. 3,686,873 to Vidal. The last embodiment shown in the drawings of that patent discloses a wall wherein panel-like stretchers are connected by a bolt which functions to both secure the panels together and to tie a "reinforced earth" type straps to the panels.

U.S. Pat. No. 3,686,873 to Vidal is also significant to the first embodiment of the invention in that it discloses connectors which are cast within cementitious retaining wall panels. These connectors, however, do not cooperate with tie rods in the manner provided by the connectors of the present invention.

My prior U.S. Pat. No. 3,922,864 is also cited as being of general significance to the invention of the present application. That patent discloses a deadman anchored retaining wall wherein anchor rods are secured to cementitious stretchers having stacking pads with rod receiving openings.

Additional art generally significant to the field of the present invention may be found in the references cited against my above discussed U.S. Pat. Nos. 3,922,864 and 4,068,482 as well as those cited against my copending application Ser. No. 839,443. Another reference generally significant to the provision of deadman or "reinforced earth" type anchors is U.S. Pat. No. 1.782,343 to Munster.

SUMMARY OF THE INVENTION

The present invention provides a deadman anchored retaining wall structure wherein improved connectors facilitate the ease of assembly and contribute to the physical integrity of the wall. The connection to the deadman anchors is accomplished by a "slip and twist" connection which requires no tools. The deadman connectors cooperate with the connectors to the stretchers in such a way that when the deadman anchor rods are positioned for cnnection to the stretchers, engagement of the deadman connectors is automatically assured.

A principal object of the first embodiment of the present invention is to provide an anchor rod terminal for a precast cementitious stretcher, which terminal encircles and encloses a vertical tie rod extending through the stretcher, and also encloses a volume of concrete through which the tie rod passes.

A principal object of the second embodiment of the invention is to provide a retaining wall make up of resilient sheet material panels which are capable of flexing to accommodate earth settlement and are so assembled as to provide weep space therebetween.

Another object of the second embodiment of the invention is to provide stretcher panels which may be nested together for storage and transportation.

Still another and more general object of the invention is to provide a deadman anchored retaining wall structure wherein ease of assembly is facilitated and the integrity of the assembled structure is assured.

Other objects and advantages of the invention will be apparent from the following description taken in conjunction with the drawing forming part of this specification.

DESCRIPTION OF THE PREFERRED EMBODIMENTS

Figure 1:
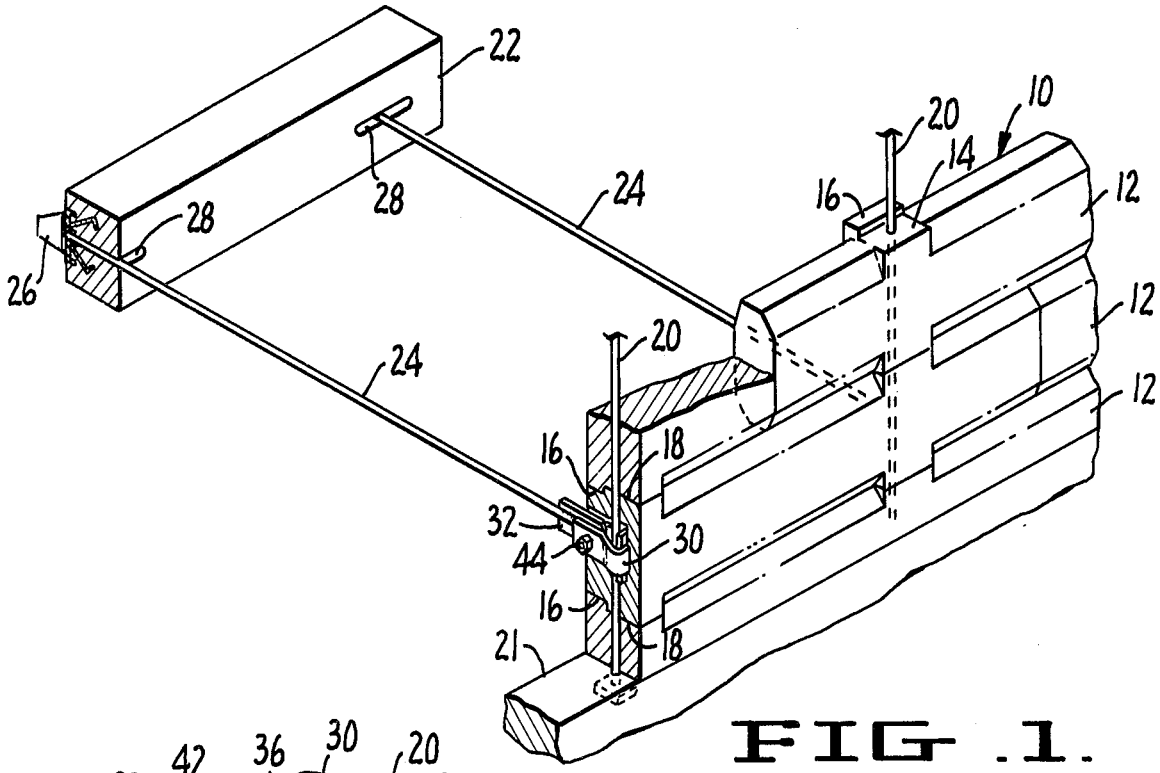
FIG. 1 is a view in perspective of a deadmananchored retaining wall section constructed according to the first embodiment of the invention.
Figure 3:
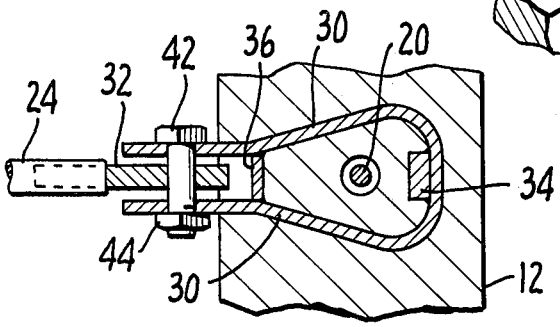
FIG. 3 is an enlarged cross-sectional view taken along the plane designated by line 3—3 of FIG. 2.
Figure 2:
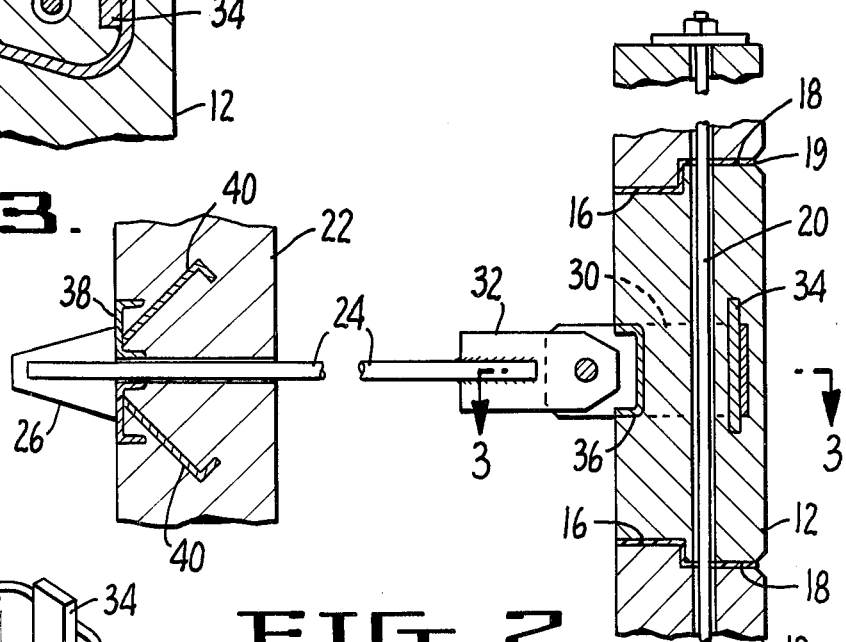
FIG. 2 is an enlarged view in side elevation and partly in section of the anchored wall of FIG. 1.
Figure 4:
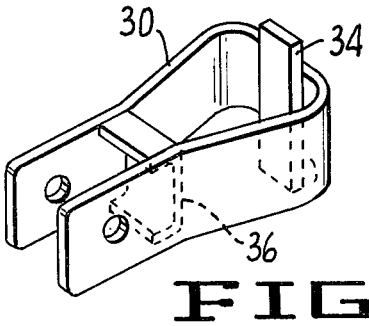
FIG. 4 is a view in perspective of the anchor rod stretcher connector of the FIG. 1 embodiment.

Referring to the first embodiment, as illustrated in FIGS. 1 to 4, the retaining wall indicated generally by 10 comprises precast, reinforced concrete stretchers 12 having stacking support heads 14 provided with complemental interlocking portions 16 and 18. Pads 19 are disposed between mating portions 16 and 18. The stretchers are provided with aligned vertical passageways through which extend vertical tie rods 20. The tie rods 20 are secured to and extend upwardly from a foundation 21.

The retaining wall 10 is connected to a precast, reinforced concrete deadman 22 by means comprising anchor rods 24, flat heads 26 attached to rods 24, admission slots 28 for the heads 26 formed in the deadman, clevises 30 cast in place in the concrete stretchers and encircling the tie rods 20, plates 32 pivotally attached to clevises 30, and a fixed connection, as by welding, between the anchor rods and plates 32. The clevises 30 are provided with reinforcement bars 34 and webs 36 which serve to reinforce the clevises as well as the adjacent concrete of the stretchers.

The outer ends of the deadman slots 28 are provided with slotted metal inserts 38 having concrete attachment and reinforcement means 40. The rods 24 are attached to deadman 22 by passing the flat heads 26 of the rods through the slots 28 and the slotted inserts 38, followed by a rotation of the rods and attached plates 32 through 90°, followed by pivotal attachment of the rods to the clevises 30 by emplacement of bolts 42 and nuts 44.

Figure 5:
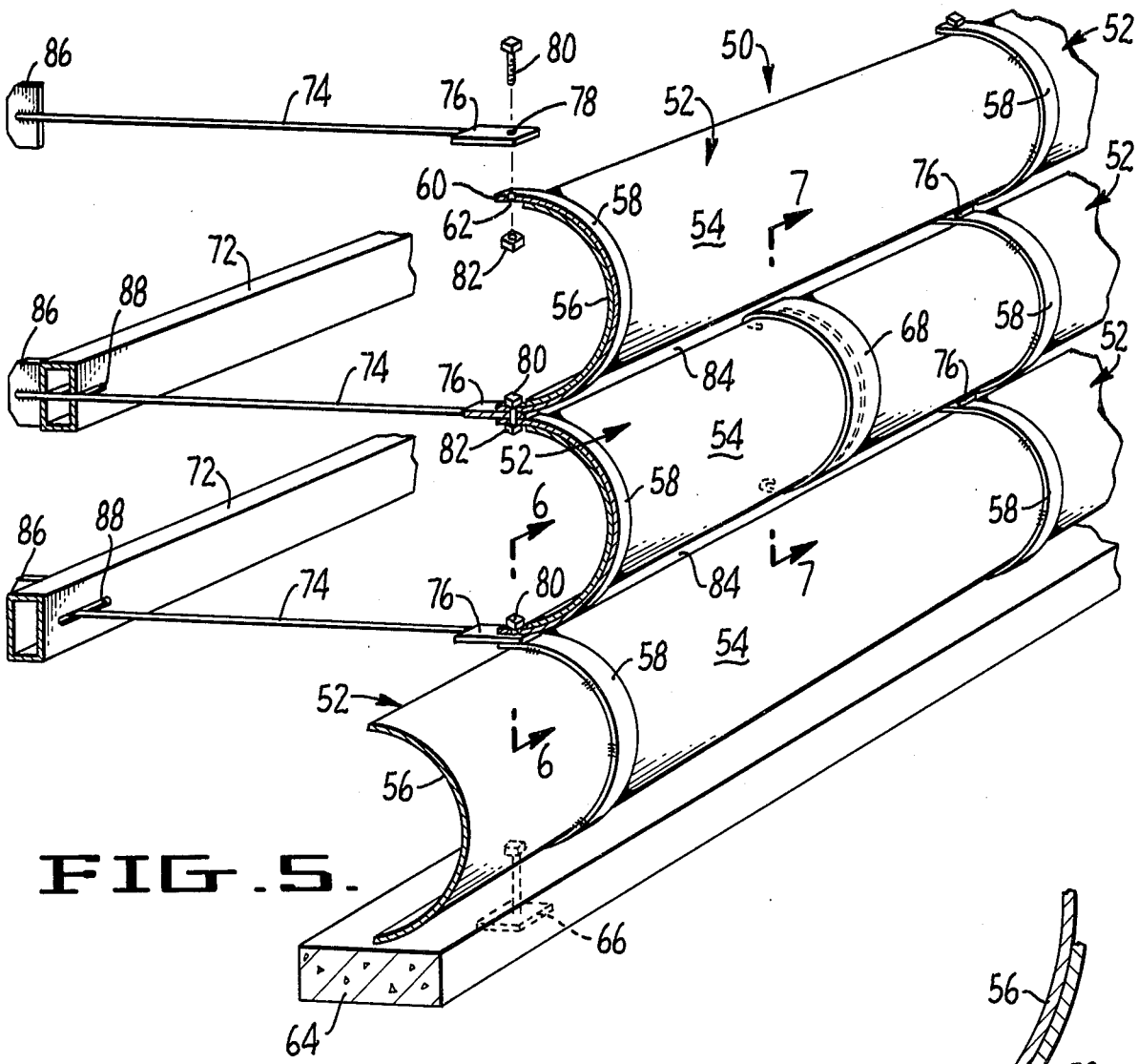
FIG. 5 is a view in perspective of a deadman anchored retaining wall section constructed according to the second embodiment of the invention.
Figure 7:
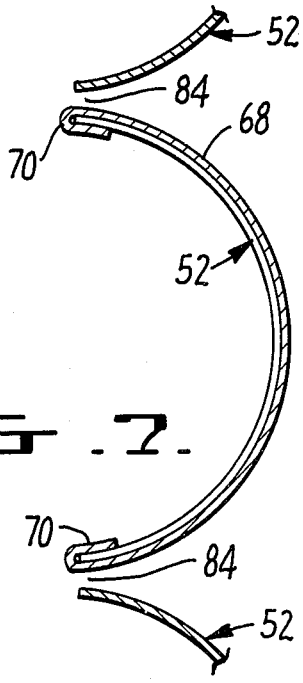
Figure 6:
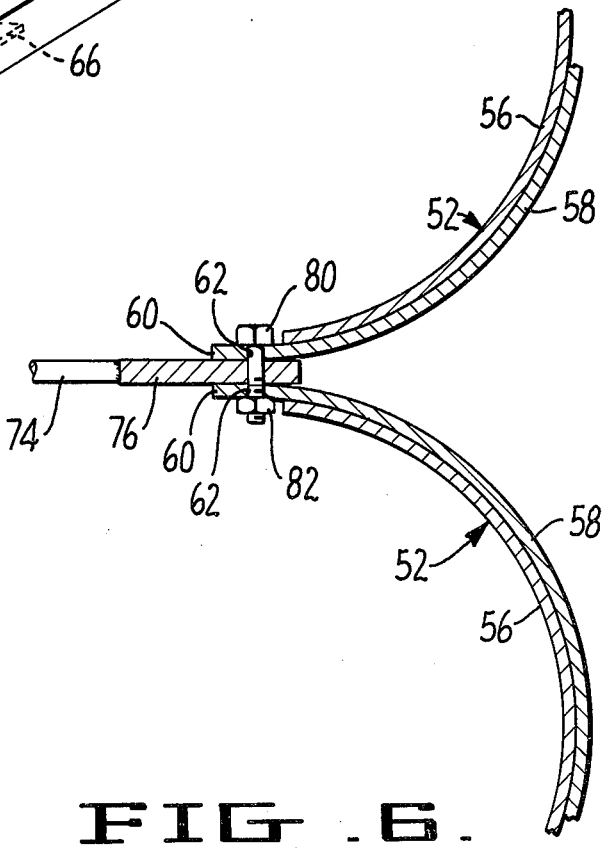
FIG. 6 is an enlarged cross-sectional view taken along the plane designated by line 6—6 of FIG. 5; and, FIG. 7 is a cross-sectional view taken along the plane designated by line 7—7 of FIG. 1.

The second embodiment retaining wall is illustrated in FIGS. 5-7 and indicated generally by the numeral 50. The principal elements of this embodiment comprise stretcher panels 52 of elongate semi-circular shell shaped configuration having convex exterior surfaces 54 and concave interior surfaces 56. In the preferred embodiment, the panels are fabricated of steel. Other suitable resilient sheet material, such as glass fiber reinforced resin, however, could be used. Each stretcher panel 52 has tack welded to the exterior surface thereof a pair of straps 58 disposed in spaced relationship relative to one another. The straps 58 extend transversely across the exterior surfaces of the panels and have end portions 60 which extend beyond the edges of the panels to the interior sides thereof. The end portions 60 are formed with bolt holes 62 to provide for securing of the panels together and to anchor rods, when the panels are assembled into a composite wall, as shown in FIG. 5.

The wall 50 is supported on a foundation 64 corresponding generally to the foundation 21 of the FIG. 1 embodiment. Inserts 66 are cast within the foundation 64 and have bolts extending upwardly therefrom for engagement with the bolt holes 62 of the lower most row of stretcher panels of the composite wall. As an alternate to the concrete foundation 64, the foundation could be fabricated as a steel section, and the insert 66 bolts could simply be welded to the top of the section.

Within each row of stretchers of the composite wall shown in FIG. 5, the opposed ends of adjacent stretchers have a semi-sleeve 68 (see FIG. 7) secured thereover. The sleeve 68 is ideally fabricated of a sheet material similar to that used for the fabrication of the stretcher panels. It is formed with bent-over ends 70 which engage over the edges of the panel. The purpose of the semi-sleeve is primarily to prevent dirt from settling out through the space between the ends of adjacent stretchers. It may also serve to aid in the asthetic appearance of the wall.

The wall 50 is anchored through means of preformed deadmen 72 and anchor rods 74 connected between the deadmen and the end portions 60 of the straps 58. Connection of the anchor rods to the end portions of the straps is provided by plates 76 fixed to the ends of the rods 74 and having bolt holes 78 extending therethrough for alignment with the bolt holes 62. In the assembled condition of the wall, the plate 76 is interposed between the end portions 60 of the straps on a pair of superimposed stretcher panels and a bolt 80 is extended through the aligned bolt holes in the end portions and the plate. Nut 82 is threadably engaged on the lower end of the bolt to secure the ends of the straps and interposed plate 56 in assembled condition and, in turn, secure the stretcher panels together.

The bolted together condition of the straps and associated anchor rods 74 can best be seen from FIG. 6. From that figure, it will also be seen that the edges of the panels 52 terminate sufficiently short of the distal ends of the end portions 60 of the straps 58 that a slot 84 (see FIG. 5) is provided between the stacked stretcher panels. Although the slot may become distorted as a result of back filling and settling, it remains sufficiently open to provide an effective weep hole.

The ends of the anchor rods 74 opposite those secured to the retaining wall are secured to the deadman 72 through means comprising flat heads 86 secured to the rods and slots 88 formed in the deadmen. The heads 86 and slots 88 are so proportioned that the heads may be aligned with and slid through the slots and the rods 84 may then be turned to position the head generally normal to the slots to thus secure the rods against displacement from the deadmen. From the top most anchor rod shown in FIG. 5, it will be appreciated that the plate 76 is disposed in normal relationship relative to the head 86. As a result of this relationship, in assembly the head 86 is first pushed through the slot 88 of its associated deadman and then the rod 74 is turned to position the plate in a horizontal plane for connection to the straps of the retaining wall. So turning the rod functions to turn the head 86 to a position wherein it will abutt against the back surface of its associated deadman. Thus, abutting engagement of the head with its associated deadman is always assured when the anchor rod 74 is secured to the retaining wall.

It should be appreciated that the heads 26 and plates 32 of the FIG. 1 to 4 embodiment also cooperate to insure that the heads are engaged behind the associated deadmen when the anchor rods are secured to the retaining wall stretchers. Because of the vertical disposition of the clevises 30, this requires that the plates 32 and heads 36 be parallel.

As illustrated, the deadmen 22 of the first embodiment are fabricated of precast cementitious material (i.e. concrete) and the deadmen 72 of the second embodiment are in the form of box sections fabricated of steel. The steel construction has the advantage that it is relatively light, as compared to the concrete construction. The concrete construction has the advantage that it is not subject to corrosion. Depending upon the circumstances, the concrete deadmen of the first embodiment could be substituted for the steel deadmen of the second embodiment, and vice-versa.

CONCLUSION

Although preferred embodiments of the invention have been illustrated and described, it should be understood that the invention is not intended to be limited to these embodiments, but rather is defined by the accompanying claims.

I claim:

1. In combination: a preformed stretcher formed of cast cementitious material, said stretcher having an integrally formed stacking head with a tie rod passages extending generally vertically therethrough; a tie rod extending through the passage; a clevis having its bight portion embedded in the cementitious material of the stretcher in encircling, spaced relation to the tie rod passage and its end protruding from the stretcher; and an anchor rod having an end thereof attached to the ends of the clevis.

2. The combination of claim 1, said end of said anchor rod being attached to a plate element which is in turn pivotally attached to the ends of said clevis.

3. The combination of claim 2, the other end of said anchor rod extending through a slot-like passageway formed in a preformed cast deadman and being provided with a flat enlarged head disposed externally of said passageway, said head being sized to pass through said passageway but being rotationally oriented as to be unable to pass therethrough.

4. The combination of claim 3, said passageway being provided at the end thereof to which said head is adjacent with a slotted reinforcement insert.

5. In combination with a retaining wall for an earthen formation, an improved system for anchoring the wall, said system comprising: a plurality of connectors secured to and extending rearwardly of the wall, said respective connectors being disposed in parallel relationship to one another and each comprising a pair of spaced apart parallel plates having aligned openings extending transversely therethrough; a plurality of anchor rods, said rods each having at one end thereof an apertured plate received between the plates of a connector on the wall and secured thereto by a pin extending through the aligned openings in the plates; a flat enlarged head secured to the other end of each rod; and a deadman anchor having a slot-like passage extending therethrough, said passage being proportioned to have the head of an anchor rod extended therethrough when the head and slot are disposed in parallel aligned relationship and to lock the head in abutting relationship to one side of the anchor when the head is extended through the slot and turned to a position wherein the apertured plate on the rod is received between and secured to the plates of a connector on the wall.

6. An improved retaining wall and anchoring structure, said structure comprising: at least one pair of elongate stretcher panels disposed one above the other, said panels being fabricated of resilient sheet material and having concave interior surfaces and concave exterior surfaces; at least two straps extending transversely of and around the exterior of each of said panels, the straps on each of the panels being disposed in spaced relationship to one another at positions wherein at least certain of the straps on the respective panels are in vertical alignment; portions on the vertically aligned straps extending in adjacent superimposed relationship to one another and beyond the interior of the panels; an anchor rod having a plate at one end thereof interposed between the superimposed end portions of the straps and secured thereto by a bolt extending through said portions and the plate; a flat enlarged head secured to the other end of the anchor rod; and a deadman anchor having a slot-like passageway extending therethrough, said passage being proportioned to have the head extended therethrough when the head and slot are disposed in parallel aligned relationship and to lock the head in abutting relationship to one side of the anchor when the head is extended through the slot and turned to a position wherein the plate at one end of the rod is interposed between superimposed portions of the straps and secured thereto.

* * * * *